US008991507B2

(12) United States Patent
Rodney et al.

(10) Patent No.: US 8,991,507 B2
(45) Date of Patent: Mar. 31, 2015

(54) GASKET FOR INDUCTIVE COUPLING BETWEEN WIRED DRILL PIPE

(75) Inventors: Paul F. Rodney, Spring, TX (US); Christopher Golla, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 663 days.

(21) Appl. No.: 13/203,815

(22) PCT Filed: Mar. 5, 2009

(86) PCT No.: PCT/US2009/001420
§ 371 (c)(1), (2), (4) Date: Aug. 29, 2011

(87) PCT Pub. No.: WO2010/101549
PCT Pub. Date: Sep. 10, 2010

(65) Prior Publication Data
US 2011/0315399 A1 Dec. 29, 2011

(51) Int. Cl.
*E21B 17/02* (2006.01)
*E21B 33/00* (2006.01)

(52) U.S. Cl.
CPC ..... *E21B 17/028* (2013.01); *E21B 2033/005* (2013.01)
USPC ..... 166/380; 166/242.6

(58) Field of Classification Search
CPC ..... E21B 17/02; E21B 17/028
USPC ..... 166/380, 242.6, 65.1
See application file for complete search history.

(56) References Cited

U.S. PATENT DOCUMENTS

| | | | | |
|---|---|---|---|---|
| 3,879,097 | A | 4/1975 | Oertle | |
| 2002/0193004 | A1 | 12/2002 | Boyle et al. | |
| 2004/0246142 | A1 * | 12/2004 | Hall et al. | 340/854.9 |

FOREIGN PATENT DOCUMENTS

| | | | |
|---|---|---|---|
| EP | 1484471 | | 2/1924 |
| EP | 14184471 | A2 | 12/2004 |
| WO | WO-2010101549 | A1 | 9/2010 |

OTHER PUBLICATIONS

"International Application Serial No. PCT/US2009/001420, Search Report mailed Dec. 4, 2009", 7 pgs.
"International Application Serial No. PCT/US2009/001420, Written Opinion mailed Dec. 4, 2009", 7 pgs.
"Australian Application Serial No. 2009341600, Examiner Report mailed Jan. 30, 2012", 1 pg.
(Continued)

*Primary Examiner* — Brad Harcourt
*Assistant Examiner* — Steven MacDonald
(74) *Attorney, Agent, or Firm* — Schwegman Lundberg & Woessner, P.A.; Benjamin Fite

(57) ABSTRACT

An apparatus comprises a gasket configured for positioning between an end of a first drill pipe and an end of a second drill pipe, wherein the end of the first drill pipe includes an inductive coil ring and the end of the second drill pipe includes an inductive coil ring. The gasket includes an outer ring that is comprised of an elastic magnetic material that is essentially nonconductive. The outer ring has a diameter that is greater than the diameters of the inductive coil rings. The gasket includes an inner ring that is comprised of an elastic magnetic material that is essentially nonconductive. The inner ring has a diameter that is smaller than the diameters of the inductive coil rings, wherein the gasket is to be positioned such that the outer ring and the inner ring are outside and inside, respectively, the diameters of the inductive coil rings.

20 Claims, 6 Drawing Sheets

(56) References Cited

OTHER PUBLICATIONS

"Australian Application Serial No. 2009341600, Response filed Sep. 17, 2012 to Examiner's Report mailed Jan. 30, 2012", 10 pgs.

"United Kingdom Application Serial No. 1104666.1, Office Action mailed Jan. 7, 2013", 7 pgs.

"United Kingdom Application Serial No. 1104666.1, Response filed Apr. 25, 2013 to Office Action mailed Jan. 7, 2013", 9 pgs.

* cited by examiner

GASKET FOR INDUCTIVE COUPLING BETWEEN WIRED DRILL PIPE

RELATED APPLICATIONS

This application is a nationalization under 35 U.S.C. 371 of PCT/US2009/001420, filed Mar. 5, 2009, and published as WO 2010/101549 on Sep. 10, 2010; which application and publication are incorporated herein by reference and made a part hereof

TECHNICAL FIELD

The application relates generally to hydrocarbon recovery. In particular, the application relates to communications along a drill pipe as part of hydrocarbon recovery.

BACKGROUND

During drilling operations for extraction of hydrocarbons, various downhole measurements (such as formation evaluation measurements, measurements related to the borehole, etc.) are typically made. Examples of the various downhole measurements include resistivity measurements, pressure measurements, caliper measurements for borehole size, directional measurements, etc. Real time access and analysis of these downhole measurements at the surface may allow for more successful, efficient and faster recovery of the hydrocarbons.

BRIEF DESCRIPTION OF THE DRAWINGS

Embodiments of the invention may be best understood by referring to the following description and accompanying drawings which illustrate such embodiments. In the drawings:

FIG. 1 illustrates an inductor 102 and an inductor 104.

FIG. 3 includes a wired drill pipe 302 and a wired drill pipe 304.

DETAILED DESCRIPTION

Methods, apparatus and systems that include a gasket for inductive coupling between wired drill pipe are described. In the following description, numerous specific details are set forth. However, it is understood that embodiments of the invention may be practiced without these specific details. In other instances, well-known circuits, structures and techniques have not been shown in detail in order not to obscure the understanding of this description. Some embodiments may be used in Measurement While Drilling (MWD), Logging While Drilling (LWD) and wireline operations.

Some drill strings used in hydrocarbon recovery include drill pipe that have one or more wires for communication, power, etc. For example, the drill pipe may include coaxial cable running along their longitudinal axis. The wire may be used for transmission of power, data communication, etc. between the surface and downhole. The ends of the sections of drill pipe may terminate in inductive couplers (which are coupled to the wire therein) to enable communication, power transmission between such sections.

For an inductively coupled telemetry system with wired drill pipe, a concern is the integrity of the connections between the sections of pipe. For example, a 2 dB loss at each connection, would result in a 60 dB loss over 30 connections (which is typically about 900 feet for standard drill pipe). Even more problematic is the possibility of a single connection being a poor connection or a connection that varies erratically (or systematically) with time. In such a situation, even if the overall signal level is strong, reliable reception of transmitted signal may be problematic. Thus, for inductive coupling, the inductive coils should be in close proximity, so that the field lines closely link the inductive coils.

Figure 1:
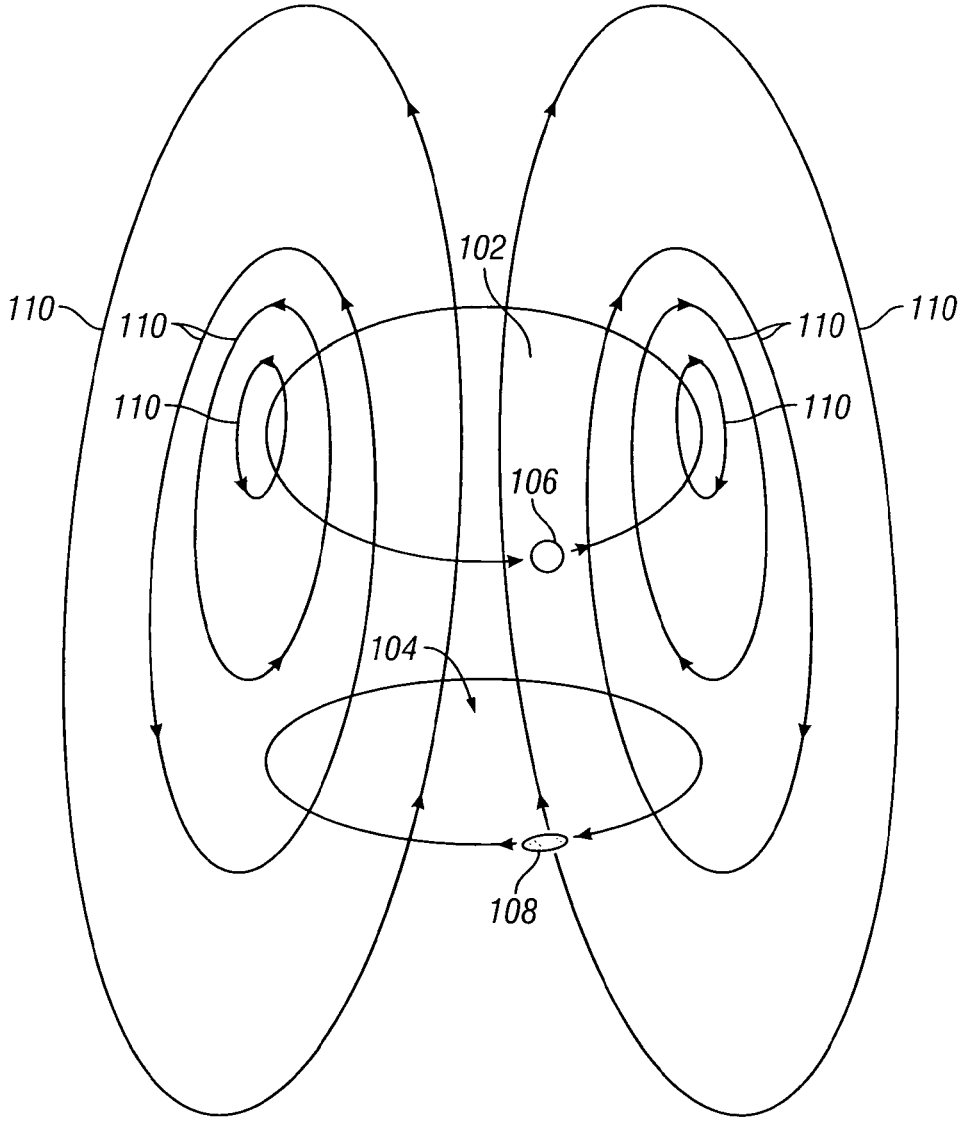
FIG. 1 illustrates magnetic flux lines linking two inductive coils, according to some embodiments.

FIG. 1 illustrates magnetic flux lines linking two inductive coils, according to some embodiments. FIG. 1 illustrates an inductor 102 and an inductor 104. The inductor 102 may be at an end of a drill pipe, and the inductor 104 may be at an end of a different drill pipe. A current source 106 drives the inductor 102. Because an electric current creates a magnetic field, the current in the inductor 102 creates magnetic flux lines 110 that link the inductor 104. When the current in the inductor 102 varies with time, the magnetic flux lines also vary with time. Accordingly, a current is induced in the inductor 104 that is dissipated in the load 108. Such a configuration can, thus, be used to communicate, without direct passage of current, from the inductor 102 to the inductor 104, or vice-versa.

If the two inductors are in close proximity, magnetic flux leakage is limited. In some embodiments, as further described below, in order to reduce flux leakage, a gasket (that assists in the completion of the magnetic circuit between the two inductive coils) is positioned between sections of the drill pipe. Accordingly, the placement of such a gasket provides for more efficient energy transmission between the inductors.

Figure 2:
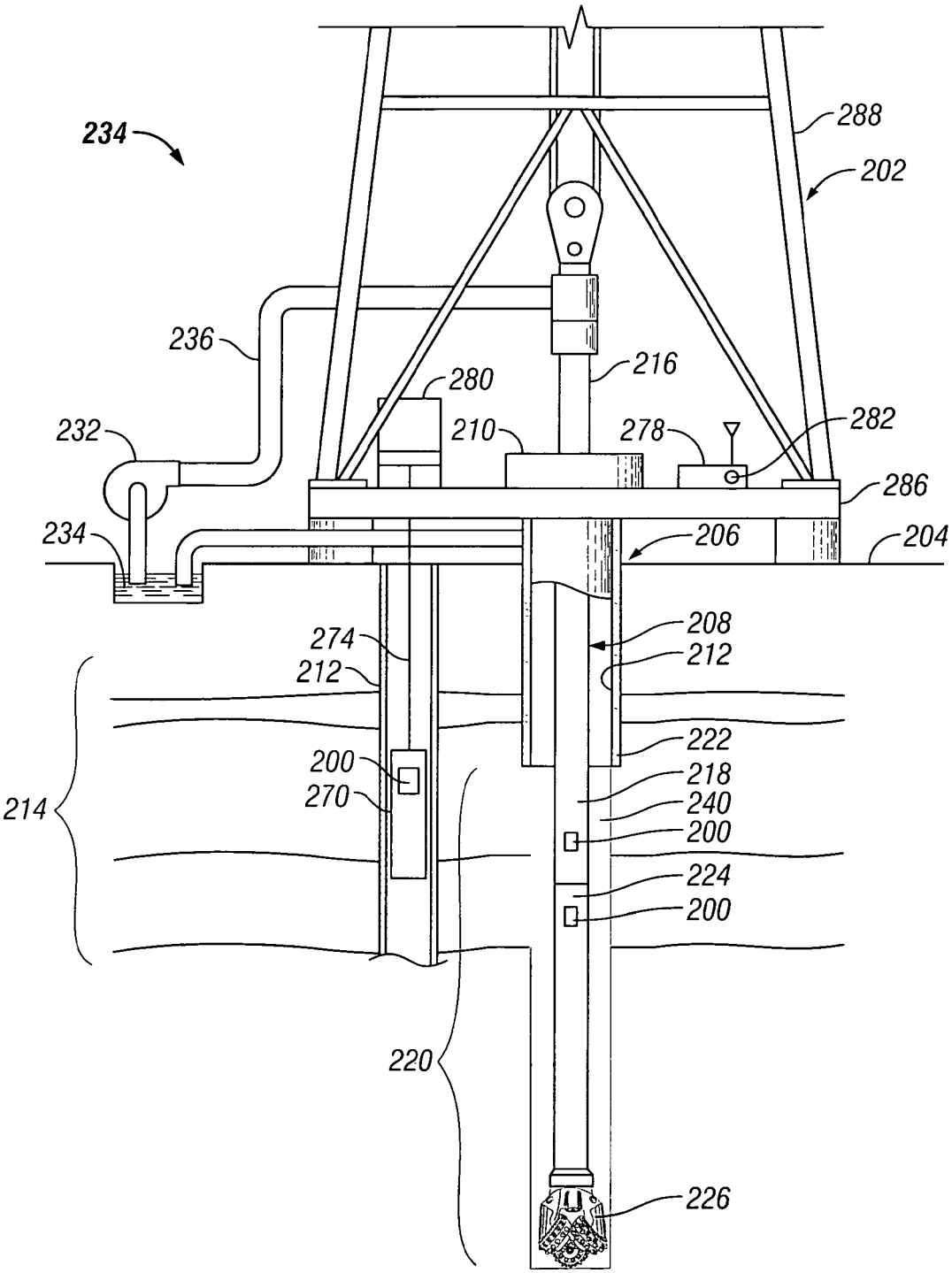
FIG. 2 illustrates a drilling well during MWD/LWD operations that includes multiple downhole tools, according to some embodiments.

A system operating environment, according to some embodiments, is now described. FIG. 2 illustrates a drilling well during MWD/LWD operations that includes multiple downhole tools, according to some embodiments. It can be seen how a system 264 may also form a portion of a drilling rig 202 located at a surface 204 of a well 206. The drilling rig 202 may provide support for a drill string 208. The drill string 208 may operate to penetrate a rotary table 210 for drilling a borehole 212 through subsurface formations 214. The drill string 208 may include a Kelly 216, a drill pipe 218, and a bottomhole assembly 220, perhaps located at the lower portion of the drill pipe 218.

The bottomhole assembly 220 may include drill collars 222, a downhole tool 224, and a drill bit 226. The drill bit 226 may operate to create a borehole 212 by penetrating the surface 204 and subsurface formations 214. The downhole tool 224 may comprise any of a number of different types of tools including MWD (measurement while drilling) tools, LWD (logging while drilling) tools, and others.

In some embodiments, the drill pipe 218 is a wired drill pipe for communications between the surface of the Earth to the downhole tool 224 and the downhole tool 225. The drill pipe 218 can include one or more communications buses for wired communication. For example, the communications buses may be coaxial cable, twisted-pair wiring, optical cabling, etc.

During drilling operations, the drill string 208 (perhaps including the Kelly 216, the drill pipe 218, and the bottomhole assembly 220) may be rotated by the rotary table 210. In addition to, or alternatively, the bottomhole assembly 220 may also be rotated by a motor (e.g., a mud motor) that is located downhole. The drill collars 222 may be used to add weight to the drill bit 226. The drill collars 222 also may stiffen the bottomhole assembly 220 to allow the bottom hole assembly 220 to transfer the added weight to the drill bit 226, and in turn, assist the drill bit 226 in penetrating the surface 204 and subsurface formations 214.

During drilling operations, a mud pump 232 may pump drilling fluid (sometimes known by those of skill in the art as "drilling mud") from a mud pit 234 through a hose 236 into the drill pipe 218 and down to the drill bit 226. The drilling fluid can flow out from the drill bit 226 and be returned to the surface 204 through an annular area 240 between the drill pipe 218 and the sides of the borehole 212. The drilling fluid may then be returned to the mud pit 234, where such fluid is filtered. In some embodiments, the drilling fluid can be used to cool the drill bit 226, as well as to provide lubrication for the drill bit 226 during drilling operations. Additionally, the drilling fluid may be used to remove subsurface formation 214 cuttings created by operating the drill bit 226.

The different components of FIG. 2 may all be characterized as "modules" herein. Such modules may include hardware circuitry, and/or a processor and/or memory circuits, software program modules and objects, and/or firmware, and combinations thereof, as desired by the architect of the systems shown in FIG. 2, and as appropriate for particular implementations of various embodiments. For example, in some embodiments, such modules may be included in an apparatus and/or system operation simulation package, such as a software electrical signal simulation package, a power usage and distribution simulation package, a power/heat dissipation simulation package, and/or a combination of software and hardware used to simulate the operation of various potential embodiments.

It should also be understood that the apparatus and systems of various embodiments can be used in applications other than for drilling and logging operations, and thus, various embodiments are not to be so limited. The illustrations of the systems of FIG. 2 are intended to provide a general understanding of the structure of various embodiments, and they are not intended to serve as a complete description of all the elements and features of apparatus and systems that might make use of the structures described herein.

Applications that may include the novel apparatus and systems of various embodiments include electronic circuitry used in high-speed computers, communication and signal processing circuitry, modems, processor modules, embedded processors, data switches, and application-specific modules, including multilayer, multi-chip modules. Such apparatus and systems may further be included as sub-components within a variety of electronic systems, such as televisions, personal computers, workstations, vehicles, and conducting cables for a variety of electrical devices, among others. Some embodiments include a number of methods.

Figure 3:
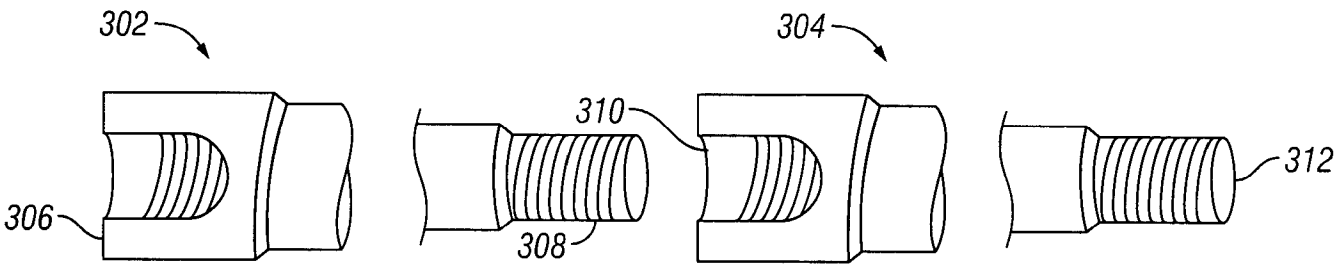
FIG. 3 illustrates wired drill pipe, according to some embodiments.

FIG. 3 illustrates wired drill pipe, according to some embodiments. FIG. 3 includes a wired drill pipe 302 and a wired drill pipe 304. The wired drill pipe 302 includes a box end 306 and a pin end 308. The wired drill pipe 304 includes a box end 310 and a pin end 312. The wired drill pipe 302 includes one or more wires (not shown) running along the longitudinal axis to enable the transmission of communication, power, etc. between the box end 306 and the pin end 308. The wired drill pipe 304 includes one or more wires (not shown) running along the longitudinal axis to enable the transmission of communication, power, etc. between the box end 310 and the pin end 312. The pin end of one drill pipe may be coupled to the box end of a second drill pipe. For example, the pin end 308 of the wired drill pipe 302 may be coupled to the box end 310 of the wired drill pipe 304 (using the threaded connections).

The box end 306, the pin end 308, the box end 310 and the pin end 312 may include an inductive coupler (such as an inductive coil). Such inductive couplers enable transmission of communication, power, etc. between sections of drill pipe without a direct connection. As further described below, some embodiments comprise a gasket to be positioned between two sections of drill pipe that are coupled together.

Figure 4A:
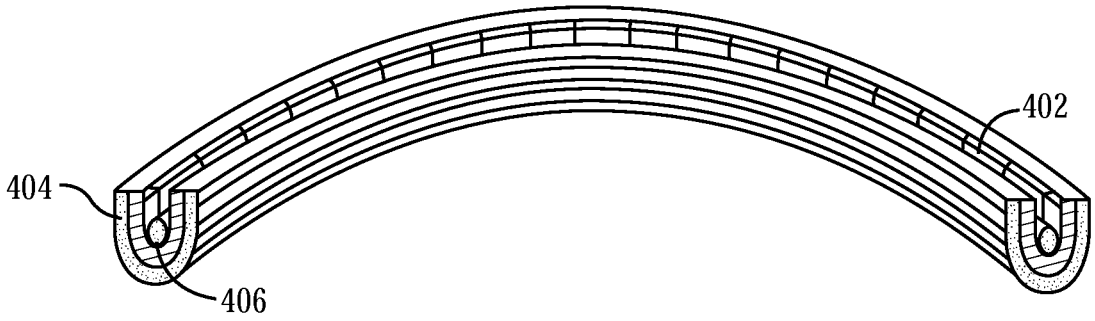
FIG. 4A is a perspective view of a communication element at an end of a drill pipe, according to some embodiments.
Figure 4B:
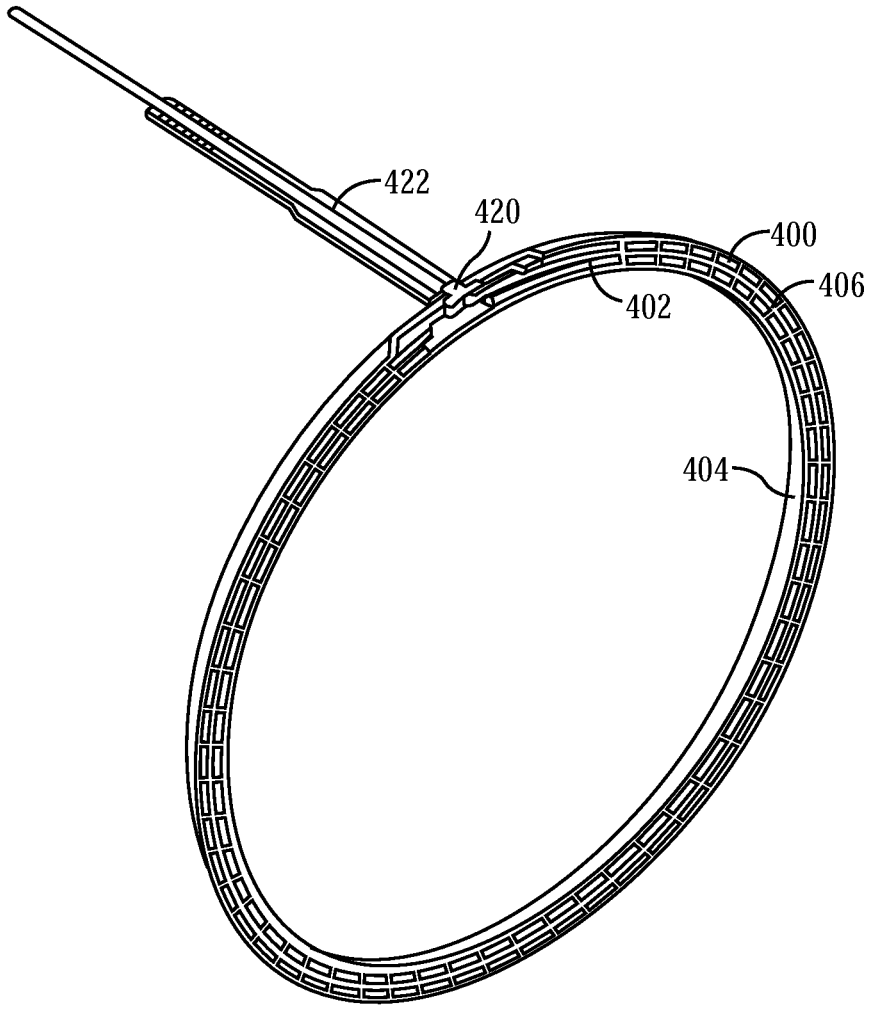
FIG. 4B is an enlarged cross-sectional view of a part of the communication element at an end of a drill pipe, according to some embodiments.

FIG. 4A is a perspective view of a communication element at an end of a drill pipe, according to some embodiments. FIG. 4B is an enlarged cross-sectional view of a part of the communication element at an end of a drill pipe, according to some embodiments. A communication element 400 includes a metallic ring 404 that contains a magnetically conducting, electrically insulating element 402. A conductive coil 406 is located within the element 402. The metallic ring 404 may be comprised of steel. A property of the element 402 is that it is magnetically conducting. The material of the element 402 is desired to have a permeability sufficiently high to keep the magnetic field out of the metallic ring 404. In some embodiments, the magnetic permeability of the element 402 is greater than that of steel, which is typically about 40 times that of air. In some embodiments, the magnetic permeability of the element 402 is greater than that of steel, which is typically about 40 times that of air. In some embodiments, the magnetic permeability is less than about 2,000. In some embodiments, the magnetic permeability is less than about 800. In other embodiments, the magnetic permeability is less than about 125.

In some embodiments, the element 402 is made from a single material. Such material can be both magnetically conductive and electrically insulating. In some embodiment, this single material is ferrite. In other embodiments, the element 402 is made from a combination of materials. For example, the material can be a combination of elements that are magnetically conductive and elements that are electrically insulating. In some embodiments, such material is "powdered iron."

In some embodiments, the element 402 is made from a number of segments of ferrite, which can be coupled together using different types of resilient material (e.g., an epoxy, a natural rubber, polytetrafluoroethylene (PTFE), perfluoroalkoxy (PFA), a fiberglass or carbon fiber composite, or a polyurethane). In some embodiments, the metallic ring 404 includes a generally u-shaped trough to allow for the placement of the element 402 therein. In some embodiments, the metallic ring 404 includes ridges around its circumference to enhance the connection of the metallic ring 404 to the drill pipe. The communication element 400 also includes a bridge 420 and a wire 422. The bridge 402 couples the communications from the element 402 to the wire 422 that is to run along the drill pipe.

Figure 5A:
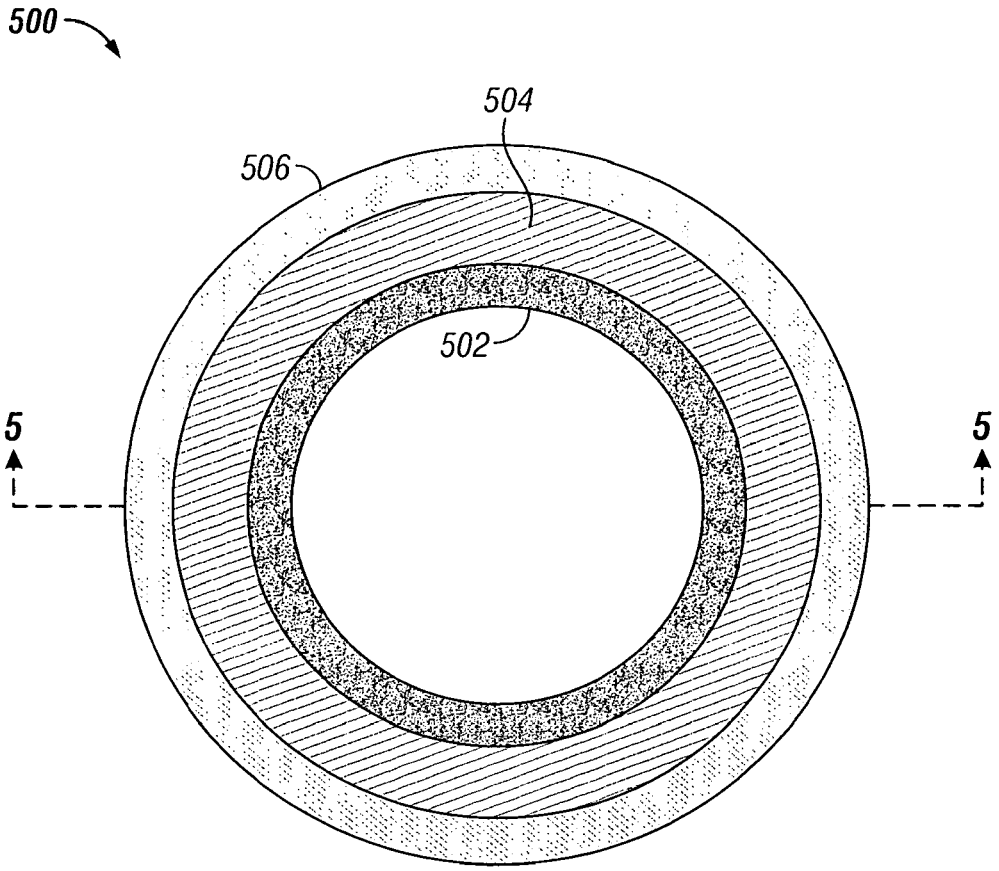
FIG. 5A is a perspective view of a gasket to be positioned between two sections of wired drill pipe for reduction of magnetic flux leakage, according to some embodiments.
Figure 5B:
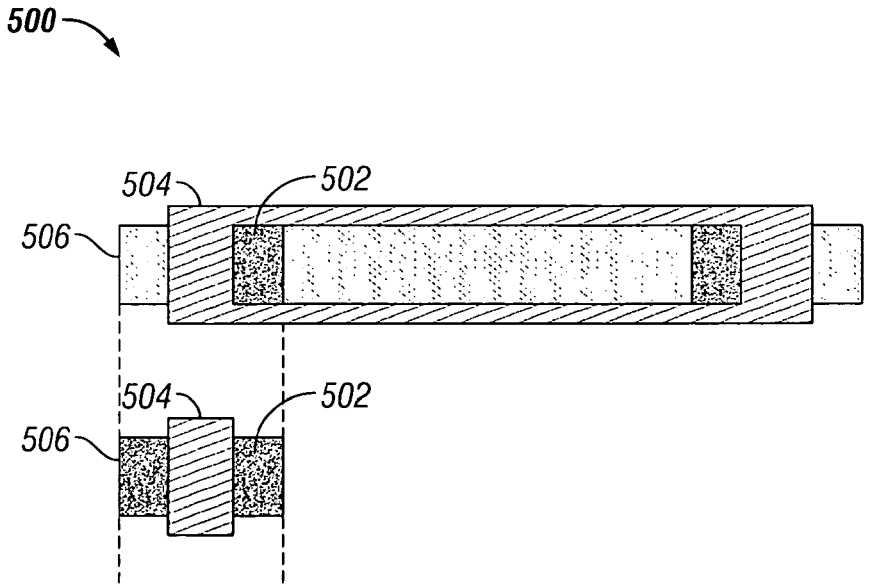
FIG. 5B is a cross-sectional view of a gasket to be positioned between the two sections of wired drill pipe for reduction of magnetic flux leakage, such as along line 5-5 of FIG. 5A, according to some embodiments.

FIG. 5A is a perspective view of a gasket to be positioned between two sections of wired drill pipe for reduction of magnetic flux leakage, according to some embodiments. FIG. 5B is a cross-sectional view of a gasket to be positioned between the two sections of wired drill pipe for reduction of magnetic flux leakage, such as along line 5-5 of FIG. 5A, according to some embodiments. In some embodiments, the gasket 500 is comprised of an elastic material. For example, the gasket may be comprised of rubber (such as carboxylated nitrile). The gasket may include three rings. The gasket 500 includes an inner ring 502 that is comprised of a material that is magnetic and essentially nonconductive. The gasket 500 includes an outer ring 506 that is comprised of a material that is magnetic and essentially nonconductive. The gasket 500 may also include a middle ring 504 positioned between the inner ring 502 and the outer ring 506. The middle ring 504 is comprised of a material that is essentially nonmagnetic and essentially nonconductive. As further described below, the inner ring 502 and the outer ring 506 reduces the amount of magnetic flux leakage for the magnetic flux from the inductive coupling between two ends of a wired drill pipe.

In some embodiments, the gasket 500 may be fabricated as three rings of elastic material, that can subsequently be joined together. The outer ring 506 and the inner ring 502 may be doped with ferrite or some other magnetic material so as to make the material permeable. The middle ring 504 would not be doped. In some embodiments, the gasket 500 may be fabricated from a single material. The single material may be doped with magnetic particles. In some embodiments, the magnetic particles used to doped the gasket material are needle shaped, or at least have one axis that is significantly loner than another axis. After the magnetic particles are dispersed into the gasket material (but prior to the material being cured or set), the gasket material is inserted into a strong magnetic field that is aligned with the axis of symmetry of the gasket. Accordingly, this causes the magnetic particles to line with the magnetic field lines. After being cured, the gasket may be run through a demagnetizing cycle. The resulting gasket should exhibit magnetic anisotropy so that the magnetic field is easily conducted between the communication elements (the inductive couplers) without shorting the magnetic field.

Figure 6:
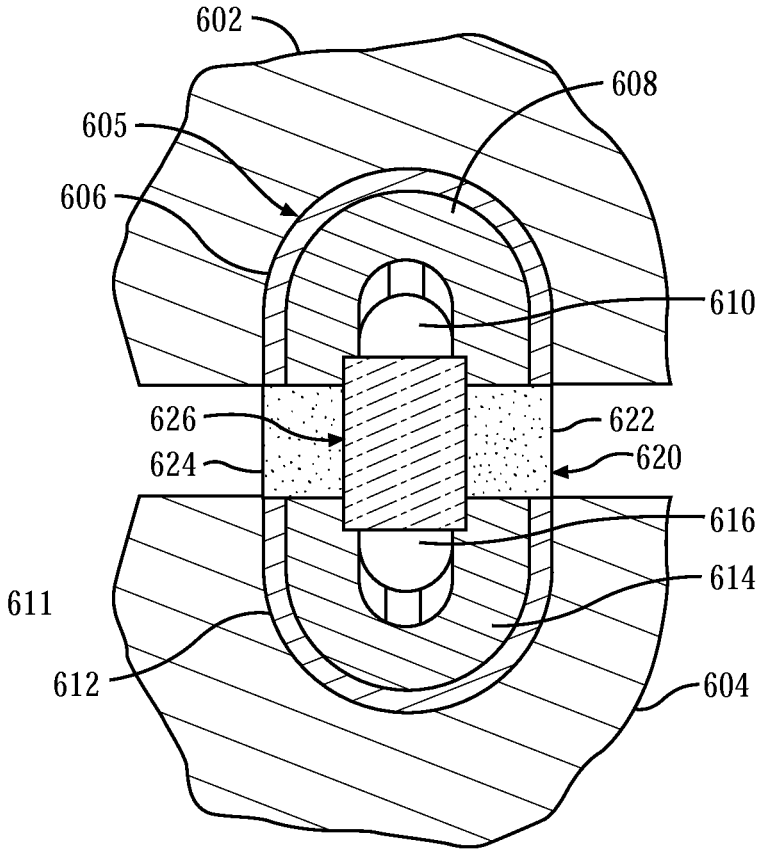
FIG. 6 is an enlarged cross-sectional view of the two sections of wired drill pipe and the gasket in between, according to some embodiments.

FIG. 6 is an enlarged cross-sectional view of the two sections of wired drill pipe and the gasket in between, according to some embodiments. FIG. 6 illustrates a section of drill pipe 602, a section of drill pipe 604 and a gasket 620. The section of drill pipe 602 comprises a communications element 605 that includes a metallic ring 606 that contains a magnetically conducting, electrically insulating element 608. The communications element 605 also includes a conductive coil 610 that is located within the element 608. The section of drill pipe 604 comprises a communications element 611 that includes a metallic ring 612 that contains a magnetically conducting, electrically insulating element 614. The communications element 611 also includes a conductive coil 616 that is located within the element 614. The conductive coils 610 and 616 may be inductive coils used for transmission of data, power, etc. using magnetic flux across the two sections of drill pipe 602 and 604.

The gasket 620 includes an outer ring 624, an inner ring 622 and a middle ring 626. As described above, the outer ring 624 and the inner ring 622 may be comprised of material that is magnetic and essentially nonconductive. The middle ring 626 is comprised of a material that is essentially nonmagnetic and essentially nonconductive. Otherwise, the gasket 620 may create a magnetic short circuit to both of the conductive coils 610 and 616.

In some embodiments, the outer diameter of the gasket 620 is approximately equal to or larger than the outer diameter of the metallic ring 606 and the metallic ring 612 that house the conductive coil 610 and the conductive coil 616, respectively. In some embodiments, the inner diameter of the gasket 620 is approximately the same or less than the inner diameter of the metallic ring 606 and the metallic ring 612 that house the conductive coil 610 and the conductive coil 616, respectively. In some embodiments, the diameter of the outer ring 624 is greater than the diameter of the conductive coil 610 and the diameter of the conductive coil 616. In some embodiments, the diameter of the inner ring 622 is smaller than the diameter of the conductive coil 610 and the diameter of the conductive coil 616. Accordingly, the gasket 620 is positioned such that the outer ring 624 and the inner ring 622 are outside and inside, respectively, the diameter of the conductive coil 610 and the diameter of the conductive coil 616. Thus, such positioning of the gasket 620 reduces magnetic flux leakage between the metallic ring 606 and the metallic ring 612. The width of the middle ring 626 may be approximately the same or larger than the width of the conductive coil 610 and the conductive coil 616. In some embodiments, the circumference of the middle ring 626 is approximately the same as the circumference of the conductive coil 610 and the circumference of the conductive coil 616.

In some embodiments, the middle ring 626 is thicker than the outer ring 624 and the inner ring 622. With proper construction of the space between the conductive coil 610 and the conductive coil 616, a notch can remain. Accordingly, the gasket 620 may be seated on and around one of the communications element prior to bringing the other communications element into contact with the gasket 620. In some embodiments, a thickness of the middle ring 626 is approximately the same as the outer ring 624 and the inner ring 622. In some embodiments, a thickness of the middle ring 626 is less than a thickness of the outer ring 624 and the inner ring 622.

In the description, numerous specific details such as logic implementations, opcodes, means to specify operands, resource partitioning/sharing/duplication implementations, types and interrelationships of system components, and logic partitioning/integration choices are set forth in order to provide a more thorough understanding of the present invention. It will be appreciated, however, by one skilled in the art that embodiments of the invention may be practiced without such specific details. In other instances, control structures, gate level circuits and full software instruction sequences have not been shown in detail in order not to obscure the embodiments of the invention. Those of ordinary skill in the art, with the included descriptions will be able to implement appropriate functionality without undue experimentation.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In view of the wide variety of permutations to the embodiments described herein, this detailed description is intended to be illustrative only, and should not be taken as limiting the scope of the invention. What is claimed as the invention, therefore, is all such modifications as may come within the scope and spirit of the following claims and equivalents thereto. Therefore, the specification and drawings are to be regarded in an illustrative rather than a restrictive sense.

The invention claimed is:

1. An apparatus comprising:

a gasket configured for positioning between an end of a first drill pipe and an end of a second drill pipe, wherein the end of the first drill pipe includes a first inductive coil ring and the end of the second drill pipe includes a second inductive coil ring, the gasket extending between the first and second inductive coil rings, the gasket comprising, an outer ring comprising an elastic magnetic material that is essentially nonconductive, the outer ring having an diameter that is greater than the diameters of the first and second inductive coil rings;

an inner ring that is comprised of an elastic magnetic material that is essentially nonconductive, the inner ring having a diameter that is smaller than the diameters of the first and second inductive coil rings, wherein the gasket is to be positioned such that the outer ring and the inner ring are outside and inside, respectively, the diameters of the first and second inductive coil rings.

2. The apparatus of claim 1, wherein the gasket further comprises a middle ring interposed between the outer ring and the inner ring, wherein the middle ring comprises an elastic material that is essentially nonmagnetic and essentially nonconductive.

3. The apparatus of claim 2, wherein a circumference of the middle ring is approximately the same as a circumference of the inductive coil rings.

4. The apparatus of claim 2, wherein the gasket is fabricated as one ring.

5. The apparatus of claim 4, wherein the outer ring and the inner ring are doped with magnetic particles during fabrication;

wherein, during fabrication, after the outer ring and the inner ring are doped and prior to the gasket being cured, the gasket is to be placed in a magnetic field aligned with an axis of symmetry of the gasket; and wherein, during fabrication, after the gasket is cured, the gasket is demagnetized.

6. The apparatus of claim 2, wherein the outer ring and the inner ring each include rubber.

7. The apparatus of claim 2, wherein a thickness of the middle ring is greater than a thickness of the outer ring or a thickness of the inner ring.

8. A drill string comprising:

a first drill pipe having a first end and a second end, wherein a path for communications or power runs between the first end and the second end of the first drill pipe, wherein the first end of the first drill pipe comprise a first inductive coil ring;

a second drill pipe having a first end and a second end, wherein a path for communications or power runs between the first end and the second end of the second drill pipe, and wherein the second end of the second drill pipe comprises a second inductive coil ring;

a gasket located between the first end of the first drill pipe and the second end of the second drill pipe, the gasket comprising, an outer ring comprising an elastic magnetic material that is essentially nonconductive;

an inner ring comprising an elastic magnetic material that is essentially nonconductive; and a middle ring interposed between the outer ring and the inner ring, wherein the gasket is to be positioned such that the outer ring and the inner ring are outside and inside, respectively, the diameters of the first inductive coil ring and the second inductive coil ring.

9. The drill string of claim 8, wherein the first end of the first drill pipe comprises a first housing containing the first inductive coil ring, wherein an outer diameter of the gasket is approximately equal to or larger than an outer diameter of the first housing, wherein an inner diameter of the gasket is approximately equal to or larger than an inner diameter of the first housing.

10. The drill string of claim 9, wherein the second end of the first drill pipe comprises a second housing containing the second inductive coil ring, wherein an outer diameter of the gasket is approximately equal to or larger than an outer diameter of the second housing, wherein an inner diameter of the gasket is approximately equal to or larger than an inner diameter of the second housing.

11. The drill string of claim 8, wherein the path for communications or power in the first drill pipe and the path for communications or power in the second drill pipe comprise a coaxial cable.

12. The drill string of claim 8, wherein a circumference of the middle ring is approximately the same as the circumferences of the first inductive coil ring and the second inductive coil ring.

13. The drill string of claim 8, wherein a thickness of the middle ring is less than a thickness of the outer ring or a thickness of the inner ring.

14. The drill string of claim 8, wherein the first end of the first drill pipe comprises a box end and the second end of the second drill pipe comprises a pin end.

15. A method comprising:

mounting a gasket on an end of a first drill pipe, the end of the first drill pipe comprising a first inductive coil ring, wherein the gasket comprises, an outer ring comprising an elastic magnetic material that is essentially nonconductive, an inner ring comprising an elastic magnetic material that is essentially nonconductive and a middle ring interposed between the outer ring and the inner ring, and wherein the mounting of the gasket is such that the outer ring and the inner ring are outside and inside, respectively, the diameter of the first inductive coil ring; and mounting an end of a second drill pipe onto the gasket, the end of the second drill pipe comprising a second inductive coil ring, wherein the mounting of the end of the second drill pipe is such that the outer ring and the inner ring are outside and inside, respectively, the diameter of the second inductive coil ring.

16. The method of claim 15, wherein the gasket further comprises a middle ring interposed between the outer ring and the inner ring, wherein the middle ring comprises an elastic material that is essentially nonmagnetic and essentially nonconductive, and wherein a circumference of the middle ring is approximately the same as a circumference of the inductive coil rings.

17. The method of claim 15, wherein the gasket is fabricated as one ring.

18. The method of claim 15, wherein the outer ring and the inner ring comprise rubber.

19. The method of claim 15, wherein a thickness of the middle ring is greater than a thickness of the outer ring or a thickness of the inner ring.

20. The method of claim 15, wherein a thickness of the middle ring is less than a thickness of the outer ring or a thickness of the inner ring.

* * * * *

UNITED STATES PATENT AND TRADEMARK OFFICE

CERTIFICATE OF CORRECTION

PATENT NO. : 8,991,507 B2
APPLICATION NO. : 13/203815
DATED : March 31, 2015
INVENTOR(S) : Rodney et al.

It is certified that error appears in the above-identified patent and that said Letters Patent is hereby corrected as shown below:

On the title page, in column 2, under "Foreign Patent Documents", line 2, delete "14184471" and insert --1484471--, therefor Signed and Sealed this
Seventeenth Day of November, 2015

Michelle K. Lee

Michelle K. Lee
*Director of the United States Patent and Trademark Office*